US008806696B2

(12) United States Patent
Mowe

(10) Patent No.: US 8,806,696 B2
(45) Date of Patent: Aug. 19, 2014

(54) COMBINATION PAINT ROLLER AND PAINT ROLLER CLEANER

(75) Inventor: William B. Mowe, Lawrenceville, GA (US)

(73) Assignee: Obvious Solotions, Inc., Marietta, GA (US)

( * ) Notice: Subject to any disclaimer, the term of this patent is extended or adjusted under 35 U.S.C. 154(b) by 0 days.

(21) Appl. No.: 11/931,727

(22) Filed: Oct. 31, 2007

(65) Prior Publication Data

US 2008/0047084 A1 Feb. 28, 2008

Related U.S. Application Data

(63) Continuation-in-part of application No. 11/259,725, filed on Oct. 26, 2005, now abandoned, which is a continuation-in-part of application No. 29/213,926, filed on Sep. 24, 2004, now Pat. No. Des. 511,600.

(51) Int. Cl.

| | |
|---|---|
| ***A47L 13/02*** | (2006.01) |
| ***B44D 3/00*** | (2006.01) |
| ***B44D 3/12*** | (2006.01) |
| *B05C 17/02* | (2006.01) |

(52) U.S. Cl.

CPC ..... *B44D 3/006* (2013.01); *B05C 17/02* (2013.01); *B44D 3/128* (2013.01); *B05C 17/0245* (2013.01)

USPC ..... 15/236.03; 15/104.04

(58) Field of Classification Search

USPC ..... 15/236.03, 236.01, 104.04, 236.07, 15/104.001; 294/15, 17, 19.2; D8/14; 7/105

See application file for complete search history.

(56) References Cited

U.S. PATENT DOCUMENTS

| | | | | |
|---|---|---|---|---|
| 2,610,884 A | | 9/1952 | Enderle et al. | 294/15 |
| 4,953,906 A | | 9/1990 | White | 294/19.2 |
| 5,335,392 A | | 8/1994 | Evans | 15/236.03 |
| 6,125,497 A | * | 10/2000 | Galbreath | 15/236.03 |

* cited by examiner

*Primary Examiner* — Shay Karls
(74) *Attorney, Agent, or Firm* — Richard B. Klas; Law Offices of Richard B Klar

(57) ABSTRACT

A combination paint roller (20) and paint roller cleaner (10) for extracting excess paint off of a paint roller sleeve. The paint roller cleaner includes a handgrip (11), an elongated rod (12), and a sleeve engaging portion defined by a generally circular loop (13) defining an internal opening. The paint roller includes a handle (21), a roller frame (22), and a roller sleeve (23). The roller sleeve has a tubular, cylindrical hollow core (24), having a select external diameter, surrounded by a tubular, cylindrical, resilient, paint absorbing matt (25) having a select external diameter. The internal diameter of the loop is larger than the external diameter of the roller core but smaller than the external diameter of the roller matt.

9 Claims, 5 Drawing Sheets

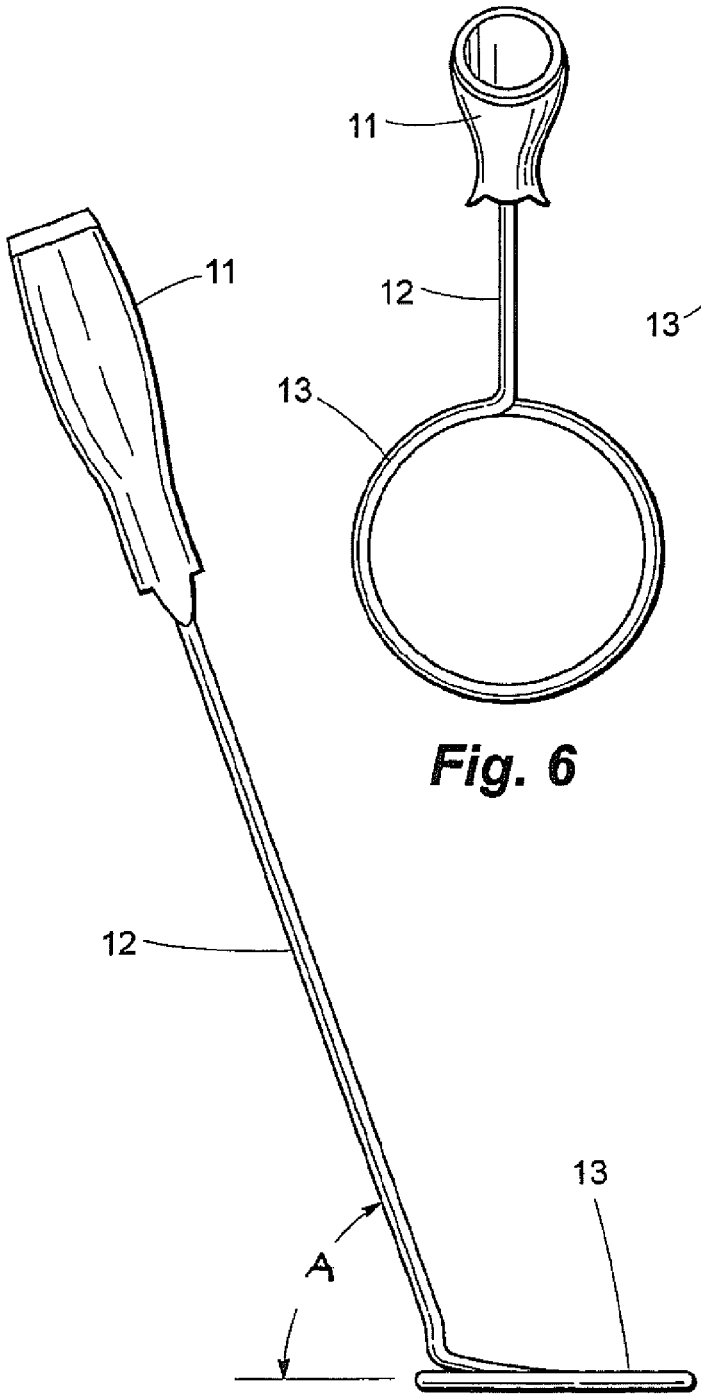
Fig. 5
Fig. 6
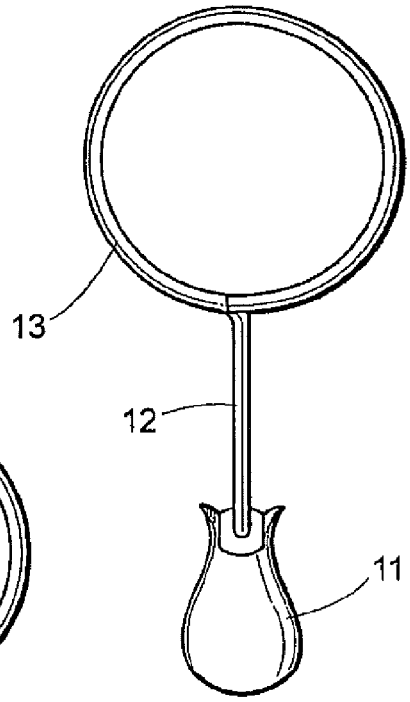
Fig. 7

COMBINATION PAINT ROLLER AND PAINT ROLLER CLEANER

REFERENCE TO RELATED APPLICATION

This is a continuation-in-part of U.S. patent application Ser. No. 11/259,725 filed on Oct. 26, 2005 now abandoned, which is a continuation-in-part of U.S. Design patent application Ser. No. 29/213,926 filed on Sep. 24, 2004, now U.S. Pat. No. D511,600.

TECHNICAL FIELD

This invention relates to a combination paint roller and cleaner for cleaning a paint roller.

BACKGROUND OF THE INVENTION

Paint rollers have been used for many years to apply paint to a surface. Once the paint roller has been used it must be cleaned to remove any excess paint.

In the past, cleaning of a roller has entailed positioning the roller under a stream of running water and manually squeezing the roller to compress the roller matt. This method of cleaning is time consuming and messy.

Therefore, a need existed to provide a paint roller and paint roller cleaner that can quickly and easily remove excess paint from the paint roller. Accordingly, it is to the provision of such that the present invention is primarily directed.

SUMMARY OF THE INVENTION

A combination paint roller and paint roller cleaner which comprises a paint roller having a handle, a sleeve, and a frame extending between the roller handle and the roller sleeve and having a select diameter. The roller sleeve has a core of a select external diameter and a matt coupled to the core and having a select external diameter. The combination also includes a paint roller cleaner having a handle portion, a rod portion, and a sleeve engaging portion extending from the rod portion opposite the handle portion. The sleeve engaging portion defines a substantially circular internal opening having a select internal diameter greater than the select external diameter of the roller core but less than the select internal diameter of the roller matt.

With this construction, passing the paint roller sleeve through the paint roller cleaner internal opening compresses the roller matt thereby squeezing the paint from the paint roller sleeve.

BRIEF DESCRIPTION OF THE DRAWINGS

FIGS. 4 and 5 are right side and left side elevational views, respectively, of the paint roller cleaner according to FIG. 1; and FIGS. 6 and 7 are top and bottom plan views, respectively, of the paint roller cleaner according to FIG. 1.

DETAILED DESCRIPTION

Figure 1:
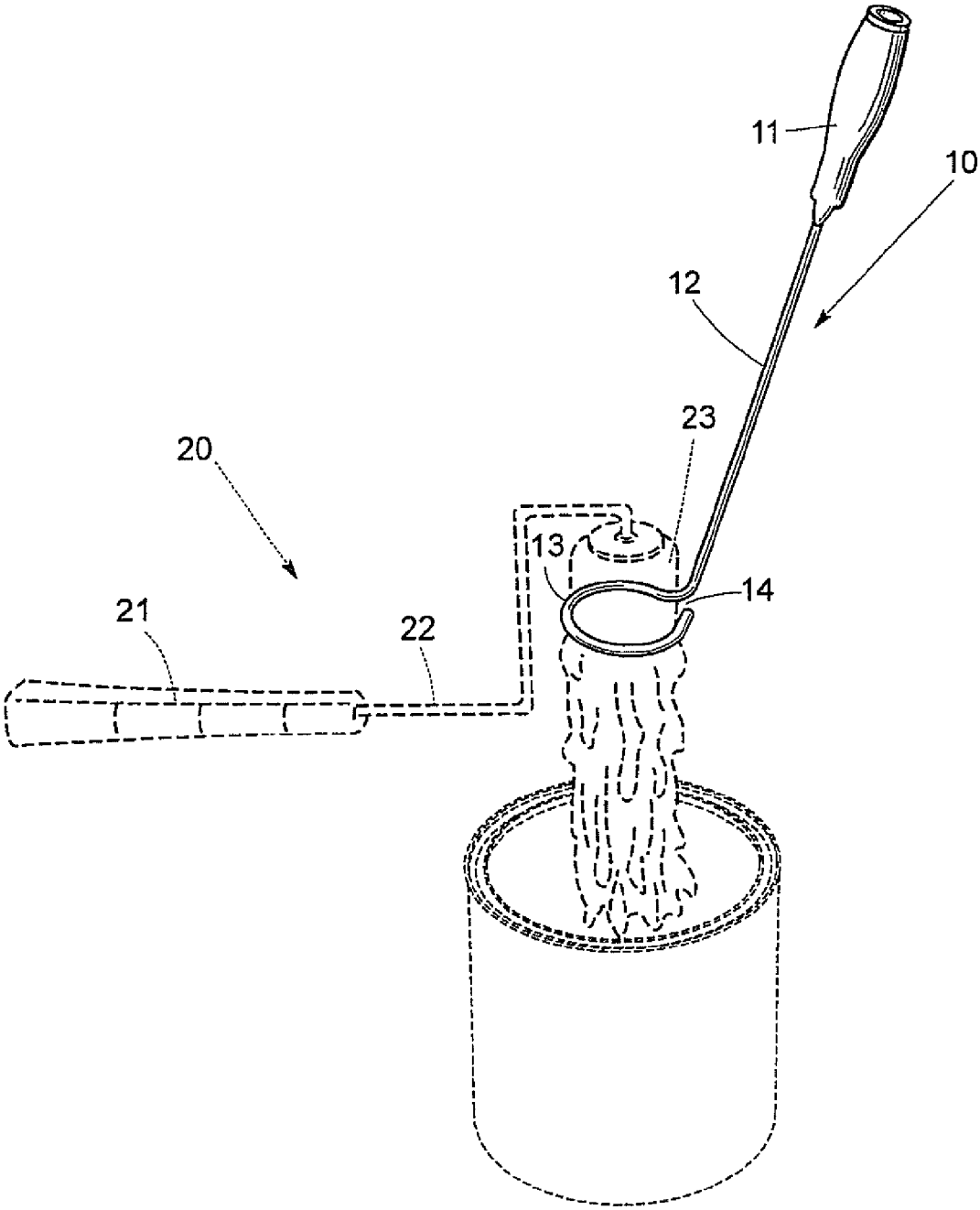
FIG. 1 is a front elevational view of the paint roller cleaner according to the present invention, the paint roller, paint dripping therefrom and the paint can being shown in dashed lines.
Figure 2:
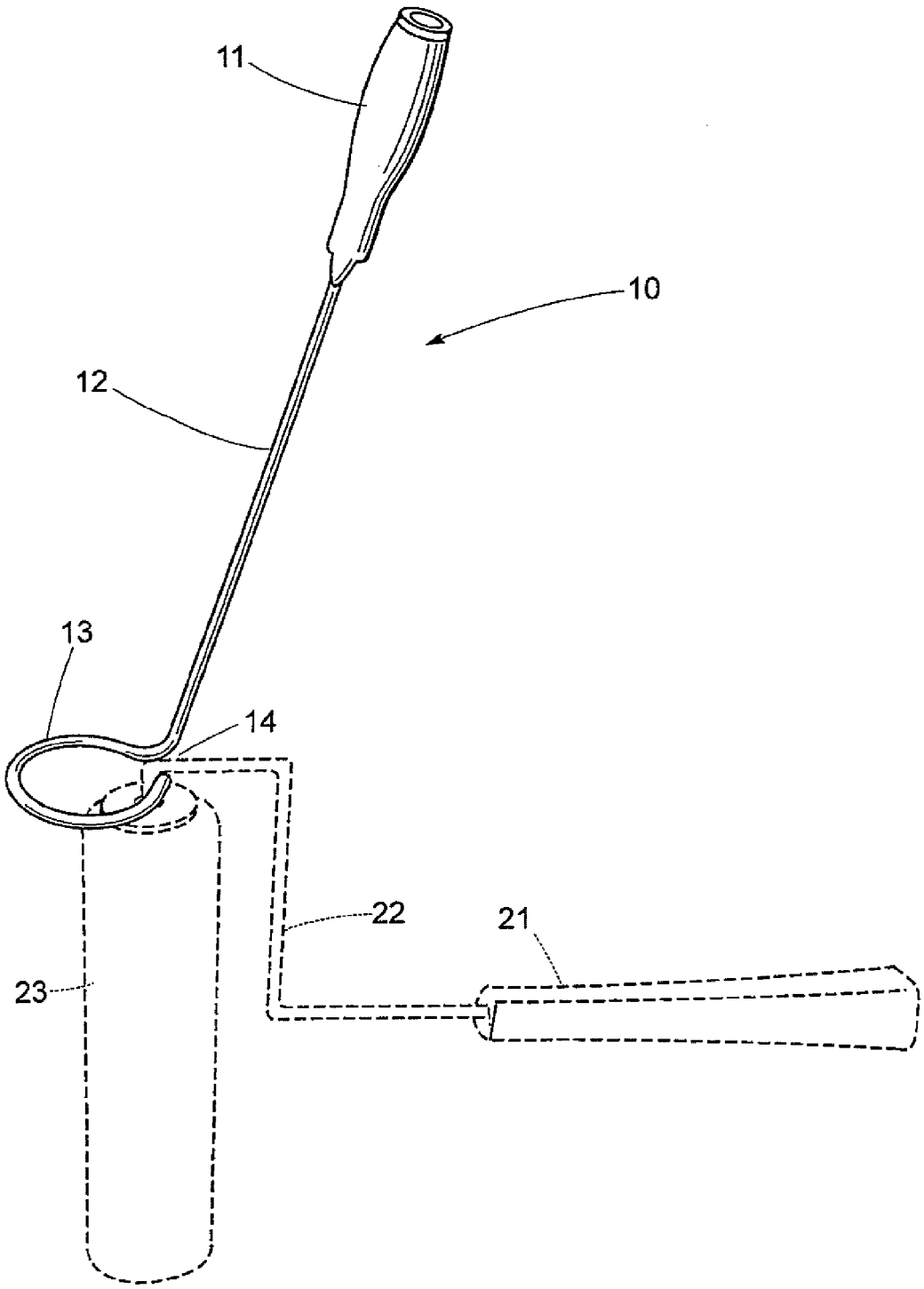
FIG. 2 is a closeup perspective view of the paint roller cleaner according to FIG. 1 showing how it can be slipped on the paint roller sleeve without requiring removal of the sleeve from the handle.
Figure 3:
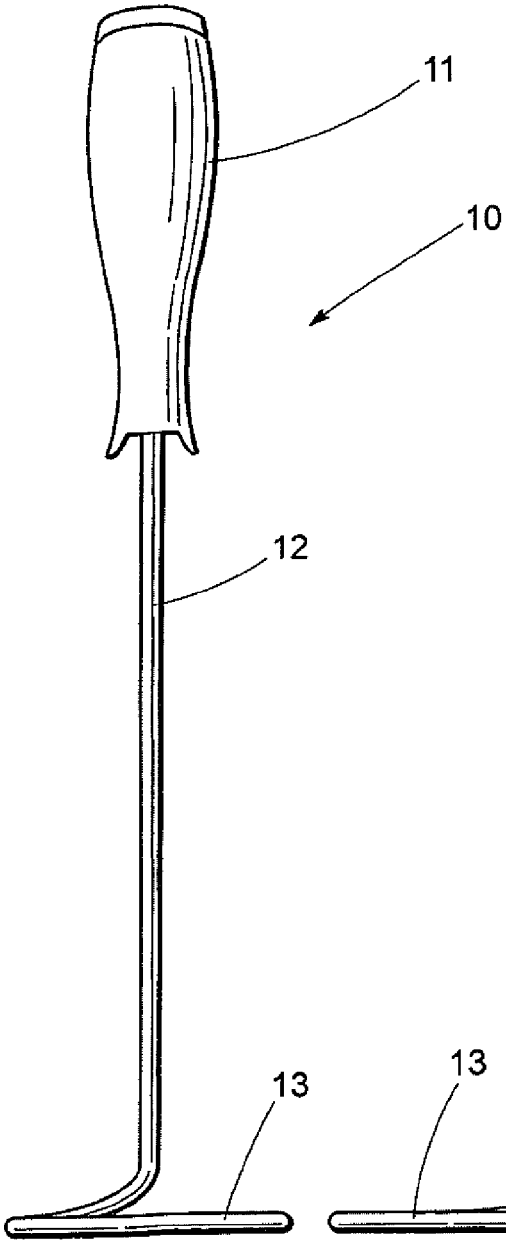
FIG. 3 is a front elevational view of the paint roller cleaner according to FIG. 1.
Figure 4:
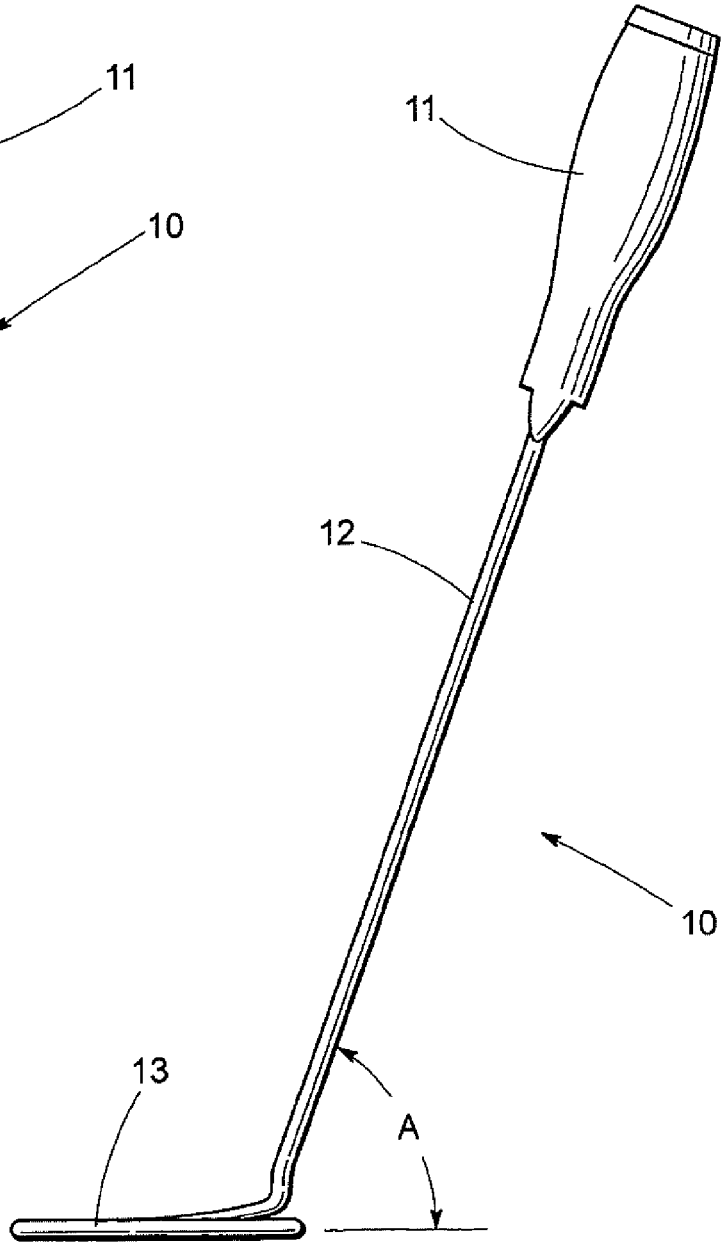
Figure 8:
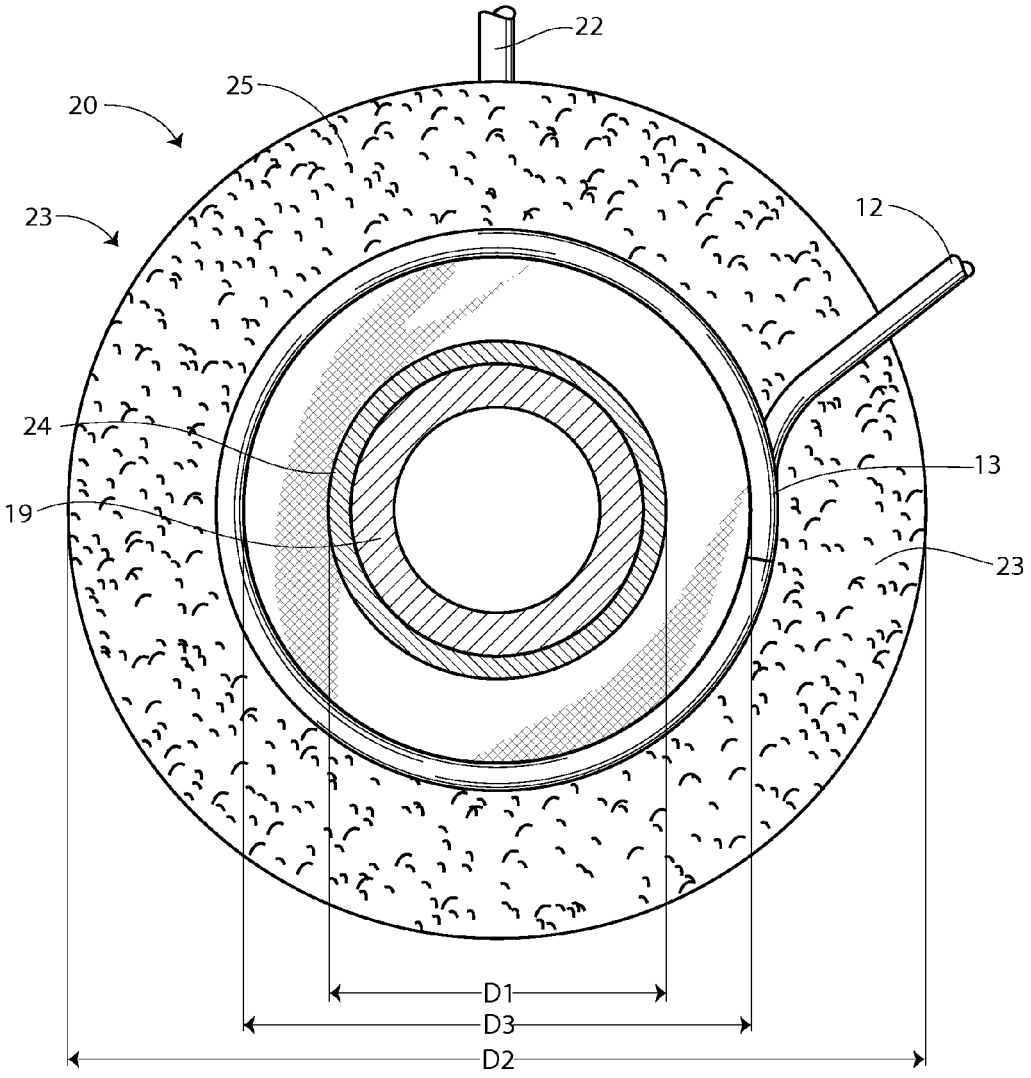
FIG. 8 is a partial cross-sectional view of a paint roller and a portion of a paint roller cleaner according to FIG. 1.

With reference next to the drawings, there is shown a combination paint roller and paint roller cleaner in a preferred form of the invention. The paint roller cleaner is generally adapted to facilitate the cleaning of a paint roller.

The paint roller cleaner 10 includes a handgrip 11 and an elongated rod 12 that extends from the handgrip. Distal from the handgrip 11, the rod 12 terminates in a sleeve engaging portion defined by a generally circular loop 13. The loop 13 defines an internal opening having an internal diameter or size D3. The loop 13 is discontinuous and helical in shape so as to define an entry gap 14 between the end of the loop and the portion immediately above it.

The paint roller cleaner 10 is designed to clean the paint from a conventional paint roller 20. The paint roller 20 includes a handle 21, a roller frame 22, and a roller sleeve 23. The handle 21 is typically an elongated member, often constructed from a polymeric material, that provides a readily graspable surface by which a user may manipulate the roller as desired.

Such handles 21 typically feature a taper that gradually enlarges along the length of the handle 21 for opposing the inadvertent release of the handle from the user's hand.

The frame 22 typically includes a first portion that extends linearly away from the handle 21, typically collinear with the longitudinal axis thereof. The frame 22 also includes a letter "C"-like portion that is disposed at the end of the frame first portion. The C-like portion includes along its end a spool-like mechanism 19 onto which the roller sleeve 23 may be removably journalled upon and secured. The spool 19 is preferably disposed generally perpendicularly to the handle 21, thereby facilitating use of the roller. The spool 19 enables the free rotation of the roller sleeve once secured thereto.

The roller sleeve 23 has a tubular core 24, having a select external diameter D1, surrounded by or concentrically mounted to a tubular, resiliently compressible, paint absorbing matt 25. The matt 25 has a select external diameter D2. The matt 25 external diameter D2 is determined while the matt is in a relaxed or uncompressed condition and is not intended to represent the external diameter of the matt when compressed through the use of the cleaner. It should also be understood that because of the nature of such matt's the diameter is not always exactly constant along its length and therefore the external diameter D2 is a general size or average along its length.

The internal diameter D3 of the loop 13 is smaller than the external diameter of the paint roller sleeve D2 in a relaxed condition but larger than the external diameter of the paint roller sleeve 23 when the outer surface of the sleeve matt 25 is compressed by the loop 13, i.e., the loop internal diameter D3 is larger than the external diameter D1 of the roller core 24 but smaller than the external diameter D2 of the roller matt 25. By way of example only, the roller core 24 may have an external diameter D1 of 1½ inches, the matt 25 may have an external diameter D2 of 4 inches, and the loop 13 may have an internal diameter D3 of 2 1/16 inches. It should be understood however that rollers may be available in other sizes. The gap 14 in the loop 13 is of a size large enough to slip over the frame 22 of the paint roller 20, i.e., the diameter of the roller frame 22 is less than the size of the gap 14.

To make the tool 10 easier to use the handgrip 11 and the rod 12 are disposed at an angle "A" to the imaginary plane in which the loop 13 generally lies at any given moment, the term "generally" being used herein since the loop may be helical and therefore not considered to be truly planar. In the preferred embodiment this angle is about 70 degrees. The offset angle decreases the likelihood of inadvertent contact between the user's hand (gripping the handle) and the sleeve while the sleeve is being cleans by the cleaner 10.

In typical operation, a user selects a suitable sleeve 23 and slides the sleeve 23 onto the roller spool 19. Thereafter, the user pours a select amount of paint into a paint tray. To initiate painting, the user rolls the sleeve in the paint tray to secure a desired amount of paint to the sleeve. The user then rolls the sleeve along the target surface, thereby applying paint to the surface. Once the user completes painting, typical practice dictates that the user remove the sleeve from the roller and clean the sleeve to remove any paint that may have remained on the sleeve. Such a cleaning operation typically entails the user holding the sleeve over a sink, running water over the sleeve and manually attempting to extricate the remaining paint from the sleeve. As know, this process is time intensive, as well as dirty, with the user typically receiving paint on the user's skin.

To use the paint roller cleaner, a user holds the paint roller 20 by its handle 21 in one hand and the paint roller cleaner handgrip 11 in the other hand. The user then passes the paint roller frame 22 through the gap 14 and pushes the loop 13 onto the sleeve 23, thereby compressing the roller matt 25. Then with a back and forth motion, the user passes the tool 10 over the sleeve 23 to remove the excess paint, the compression of the matt 25 causing paint to be expelled from the matt with each pass of the cleaner 10. The movement of the tool 10 may be accomplished under a flow of water. Once a desired amount of paint has been removed, the user disengages the cleaner 10 from the roller sleeve, and is thereby able to reuse the sleeve for future painting activity.

It should be understood that the sleeve engaging portion may be made in alternative configurations, as opposed to the loop shown in the preferred embodiment. For example, the sleeve engaging portion may be made of a generally planar material with a circular opening therein, the opening having a smaller internal diameter or size D3 than the external diameter or size D2 of the roller matt and a larger diameter D3 than the external diameter D1 of the roller core.

It thus is seen that a paint roller cleaner is now provided that provides a manner to clean the paint from rollers in an efficient manner. It should be understood that many modifications may be made to the specific preferred embodiment described herein, in addition to those specifically recited, without departure from the spirit and scope of the invention as described by the following claims.

The invention claimed is:

1. A combination paint roller and paint roller cleaner, comprising;

a paint roller having a handle, a sleeve, and a frame extending between said roller handle and said roller sleeve, said roller frame having a select diameter, said roller sleeve having a core with a select external diameter and a matt coupled to said core and having a select external diameter, and a paint roller cleaner having a handle portion having a longitudinal axis, a rod portion having a longitudinal axis that is coaxial with that of the longitudinal axis of the handle portion, and a sleeve engaging portion extending from said rod portion opposite said handle portion, said sleeve engaging portion defining a substantially circular internal opening forming a helical loop having a select internal diameter greater than said select external diameter of said roller core but less than said select external diameter of said roller matt, said loop having an entry gap, said entry gap having a size greater than said select diameter of said roller frame, said loop having an end portion that is at a level lower than a beginning portion of said loop within respect to a length of said roller frame so that said loop entirely encircles said circumference of said sleeve and said gap is provided between said distance between said level of said beginning portion of said loop and said end portion of said loop to permit said roller frame to fit within said gap, said sleeve engaging portion being disposed in a plane whereby passing the paint roller sleeve through the paint roller cleaner internal opening compresses the roller matt thereby squeezing the paint from the paint roller sleeve, the longitudinal axis of the handle portion and of the longitudinal axis of the rod portion are disposed at an acute angle to the plane of the sleeve engaging portion, said rod's angled disposition in relation to said sleeve compresses said sleeve to squeeze paint out of said sleeve without tearing said sleeve during compression and keeps the paint from collecting on a user's hand while cleaning.

2. The combination paint roller and paint roller cleaner of claim 1 wherein said sleeve engaging portion is a substantially circular looped rod.

3. The combination paint roller and paint roller cleaner of claim 1 wherein said paint roller cleaner rod portion is set at an angle from a plane including said sleeve engaging portion.

4. A combination paint roller and paint roller cleaner, comprising;

a paint roller having a frame and a sleeve rotatably mounted to said frame, said roller frame having a select size, said roller sleeve having a core of a select size and a matt having a select size in a relaxed condition and concentrically mounted about said core, and a paint roller cleaner having a handle portion having a longitudinal axis and a sleeve engaging portion having a longitudinal axis that is substantially perpendicular thereto, said sleeve engaging portion defining a substantially circular internal opening having a select size greater than said select size of said roller core but less than said select size of said roller matt, said sleeve engaging portion being disposed in a plane whereby passing the paint roller sleeve through the paint roller cleaner internal opening compresses the roller matt thereby squeezing the paint from the paint roller sleeve, said opening forming a helical loop said loop having an entry gap, said entry gap having a size greater than said select diameter of said roller frame, said loop having an end portion that is at a level lower than a beginning portion of said loop within respect to a length of said roller frame so that said loop entirely encircles said circumference of said sleeve and said gap is provided between said distance between said level of said beginning portion of said loop and said end portion of said loop to permit said roller frame to fit within said gap, and the longitudinal axis of the handle portion and of the longitudinal axis of the rod portion are disposed at an acute angle to the plane of the sleeve engaging portion, said rod's angled disposition in relation to said sleeve compresses said sleeve to squeeze paint out of said sleeve without tearing said sleeve during compression and apply more pressure by compressing the paint roller sleeve to squeeze paint out of said paint roller sleeve due to the rod's angled disposition in relation to the sleeve engaging portion.

5. The combination paint roller and paint roller cleaner of claim 4 wherein said sleeve engaging portion is substantially a circularly looped rod.

6. The combination paint roller and paint roller cleaner of claim 5 wherein said looped rod forms a helical loop.

7. The combination paint roller and paint roller cleaner of claim 6 wherein said helical loop defines a entry gap, said entry gap having a size greater than said select diameter of said roller frame.

8. The combination paint roller and paint roller cleaner of claim 4 wherein said sleeve engaging portion includes an entry gap, said entry gap having a size greater than said select diameter of said roller frame.

9. The combination paint roller and paint roller cleaner of claim 4 wherein said paint roller cleaner rod portion is set at an angle from a plane including said sleeve engaging portion.

* * * * *